US006216695B1

(12) United States Patent
Ruben

(10) Patent No.: US 6,216,695 B1
(45) Date of Patent: Apr. 17, 2001

(54) DISPOSABLE SURGICAL FACE MASK WITH RETRACTABLE EYE SHIELD

(75) Inventor: Philip H. Ruben, Beverly Hills, CA (US)

(73) Assignee: Softy-Flex Inc., Los Angeles, CA (US)

( * ) Notice: Subject to any disclaimer, the term of this patent is extended or adjusted under 35 U.S.C. 154(b) by 0 days.

(21) Appl. No.: 09/074,339

(22) Filed: May 7, 1998

(51) Int. Cl.[7] ..... A62B 18/02; A62B 23/02; A62B 7/10

(52) U.S. Cl. ..... 128/206.19; 128/206.12; 128/206.23; 128/201.15; 128/201.17; 128/857; 2/9; 2/432

(58) Field of Search ..... 128/200.27, 200.28, 128/201.12, 201.14, 201.15, 201.17, 201.24, 205.27, 205.29, 206.12, 206.13, 206.19, 206.21, 206.23, 206.28; 2/6.3, 6.7, 9, 12, 15, 173, 266, 426, 431, 432, 438, 454

(56) References Cited

U.S. PATENT DOCUMENTS

| | | | | |
|---|---|---|---|---|
| 2,423,272 | * | 7/1947 | Thornton | 351/47 |
| 2,686,310 | * | 8/1954 | Schweikert | 2/8 |
| 3,756,692 | * | 9/1973 | Scott | 350/160 |
| 3,782,810 | * | 1/1974 | Marker | 351/47 |
| 4,039,254 | * | 8/1977 | Harsch | 350/160 |
| 4,071,912 | * | 2/1978 | Budmiger | 2/8 |
| 4,621,378 | * | 11/1986 | Hatchman | 2/9 |
| 4,944,294 | * | 7/1990 | Borek, Jr. | 128/206.19 |
| 5,020,533 | * | 6/1991 | Hubbard et al. | 128/206.23 |
| 5,150,703 | * | 9/1992 | Hubbard et al. | 128/206.12 |
| 5,191,468 | * | 3/1993 | Mases | 359/361 |
| 5,383,450 | * | 1/1995 | Hubbard et al. | 128/206.23 |
| 5,469,229 | * | 11/1995 | Greenbaum | 351/44 |
| 5,704,349 | * | 1/1998 | Hubbard et al. | 128/206.19 |
| 5,813,398 | * | 9/1998 | Baird et al. | 128/201.17 |
| 6,026,511 | * | 2/2000 | Raumann et al. | 2/9 |

* cited by examiner

*Primary Examiner*—Dennis Ruhl
*Assistant Examiner*—Joseph F. Weiss, Jr.
(74) *Attorney, Agent, or Firm*—Paul J. Stutton; Barry G. Magidoff

(57) ABSTRACT

A surgical mask adapted to cover the nose, mouth and eyes of the wearer is disclosed. A transparent lens component is positioned to cover the eyes of the user. A light-transmitting filter element being hingably connected to the upper edge of the transparent lens. The filter may be positioned selectively into overlapping relation of the lens to provide a filtering function or folded 180° to remove the filter from overlapping relation of the lens panel. The filter and lens panel are connected such that a degree of relative lateral movement between the components is provided whereby the filter may be moved between overlapping and non-overlapping conditions of the lens without removing the mask from the wearer.

4 Claims, 2 Drawing Sheets

DISPOSABLE SURGICAL FACE MASK WITH RETRACTABLE EYE SHIELD

BACKGROUND OF THE INVENTION

The present invention is directed to a surgical mask, the term "surgical" as used herein being intended to encompass uses other than strictly surgical procedures, including, by way of example, industrial, hygienists, dental assistants, and the like. The filter could also be a polarizing filter. More particularly, the device of the instance invention is directed to a disposable, relatively inexpensive mask which will protect the user against air-borne infections, and will also protect the eyes against harmful rays generated in procedures such as dental bonding, laser surgery, and the like.

DESCRIPTION OF PRIOR ART

It is conventional practice for dentists, doctors, hygienists and the like, who work in proximate relation to patients carrying possible commutable diseases, to wear a mask which covers the nose and mouth to filter air-borne bacteria. It is also known that infectious elements may be communicated to the body by lodging in the mucus membranes of the eye. To guard against infection from these sources, it is known to provide, in combination with a respiratory filtering mask, a transparent panel which will prevent air-borne particles and bacteria elements from contacting the mucus membranes.

In particular, in certain types of dental procedures, including, in particular, bonding procedures, compliance with OSHA requirements mandate the use of a mask which protects the eyes of the operative. Most dentists practicing bonding procedures do not utilize masks having eye shields because they must frequently don and take off protective eyeglasses during the bonding procedure. This is true despite the fact that a mask having a built-in shield will provide better protection than a mask and separate glasses.

In the course of practicing procedures such as bonding procedures, it is desirable to have a mask providing clear, unfiltered vision during certain aspects of the procedure and readily accessible filtered vision during components of the bonding procedure where harmful rays are encountered, without removing the mask. While its feasible to fabricate a permanent and reusable mask having these features, such devices are expensive and require sterilization between uses.

Accordingly, there is a need for a surgical mask which is inexpensive and disposable, which protects the wearer against both respiratory mucus membrane contaminants, which may be shipped flat-wise, and which enables the wearer to have visual access to the patient through both a transparent component and, as required, through a filtered component without removing the mask.

SUMMARY OF THE INVENTION

The present invention may be summarized as directed to a disposable surgical mask adapted to be shipped flat-wise and being arcuately deflectable to encompass the face of the user. The device includes a filtering arrangement for the nose and mouth in conjunction with a visual protection assembly incorporating a clear flexible lens area and a filtering lens area. The clear and filtering lens components are movably interconnected, preferably by a unique hinge, such that the filtering component, without removing the mask, can be shifted to an overlapping relation with the clear component to selectively provide a filtered and unfiltered visual access to the patient.

The filtering lens may be designed specific to the intended procedure, i.e., an orange colored filter for bonding procedures, etc. A significant feature of the invention resides in the manner in which the filtered component is connected to the clear component of the mask; and specifically unique, a hinge connection is utilized, enabling a 180° relative movement of the filter and clear lenses in the arcuate, as worn, condition of the lenses.

Importantly, the mask structure may be supplied flat-wise, and when arcuately configured or bowed to accommodate the face of the user, the filter component and clear lens component cooperate to define a desirable shape-retaining structure.

It is accordingly an object of the invention to provide a surgical mask which protects the user against contamination which may enter the user's body, either through the respiratory tract or the mucus membranes of the eyes. A further object of the invention is the provision of a device of the type described, which incorporates an optical filter which may be selectively incorporated in or removed from the visual portion, without removing the mask. Still a further object of the invention is the provision of a device of the type described which is inexpensive and hence disposable, which may be shipped flat-wise, and which may, when configured about the face of the user, provide a relatively rigid, stable structure.

DETAILED DESCRIPTION OF THE DRAWINGS

Figure 1:
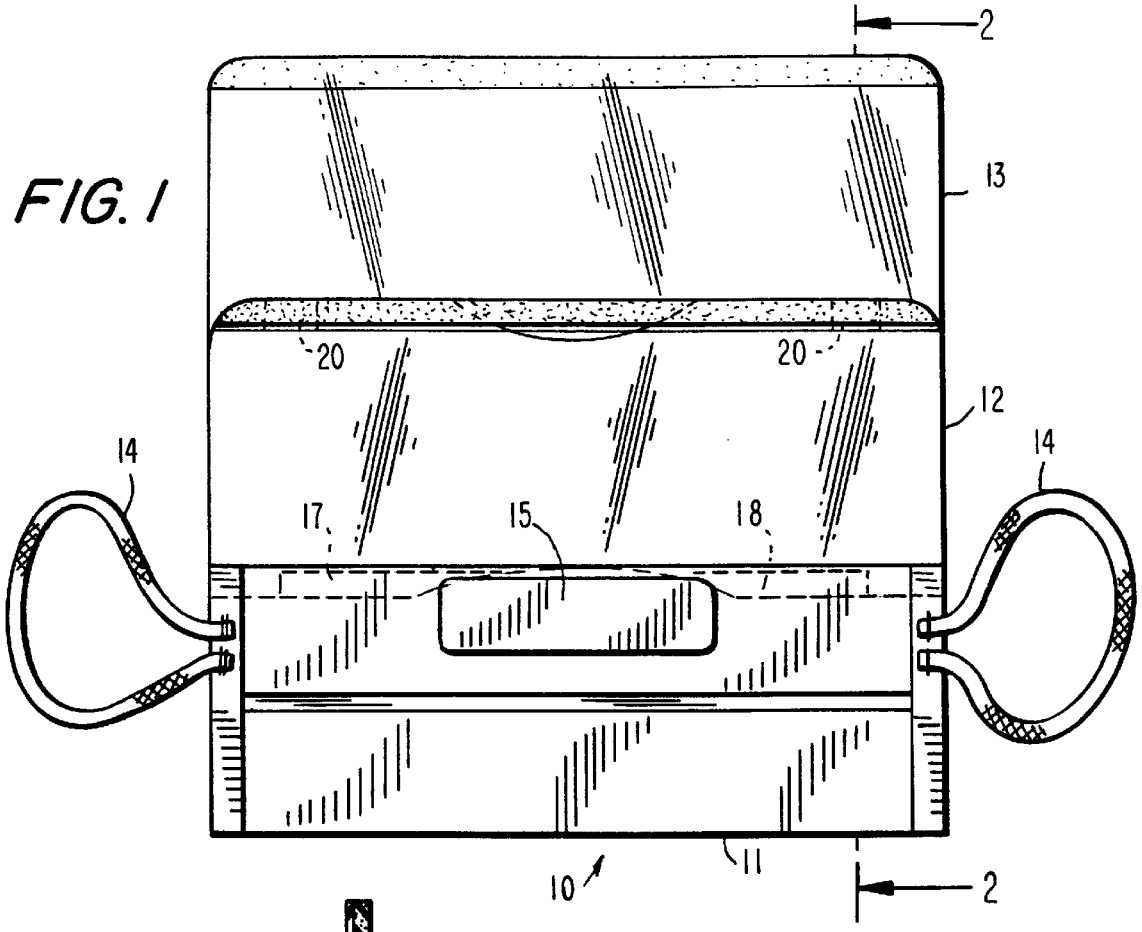
FIG. 1. is a front elevational view of a mask in accordance with the invention.

Referring to FIG. 1, there is disclosed a surgical mask assembly 10 comprised generally of a respiratory protector assembly 11 known per se, a clear lens component 12 and an optical filter component 13. The respiratory protector 11 is provided with means to secure the assembly over the face of the wearer. In the illustrated embodiment, the securing means comprise a pair of elastic loops 14 which are worn over the ears and a pressure-sensitive adhesive pad 15 for bonding to the nose of the wearer.

The lens 12 is secured to the member 11 adjacent the upper edge 16 of the respiratory filter, preferably at laterally spaced points, e.g., 17, 18. Desirably, affixation of the members 11, 12 is effected with the interposition of foam members 19 at the areas 17, 18, opposed surfaces of the foam members being secured to the components 11, 12.

Figure 5:
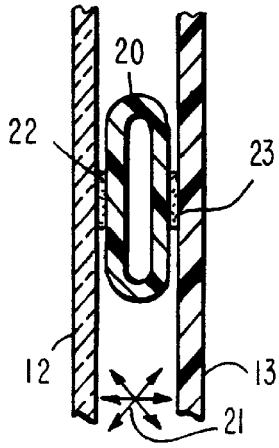
FIG. 5 is a fragmentary magnified section taken on lines 5—5 of FIG. 4, illustrating the composite hinging and bodily movement of the components.

The optical filter component 13 is mounted to the clear lens 12 by a laterally spaced pair of hinge components 20. As best seen in FIG. 5, the hinges 20 are calculated to accommodate both hinging and bodily relative movement of the optical filter component 13 and clear lens 12, i.e., in the direction of the various arrows 21. It will be understood that lens 12 is comprised of a clear, flexible polymeric material such as an acetate, or a vinyl polymer, and the optical filter component 13 is likewise a flexible polymeric material, but incorporates a filtering component which removes or attenuates the passing to the eye of the operator of a selected wavelength or wavelengths of light. By way of a preferred example, for use in connection with dental bonding procedures using laser light beams, the optical filter component 13 may include an orange filter component. It will be readily recognized that the optical filter component 13 may be formulated to filter selected wavelengths, such as the ultraviolet or infrared light from surgical, laser, or possibly even x-rays.

Figure 2:
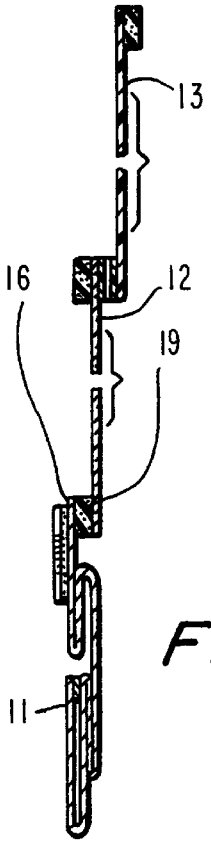
FIG. 2 is a sectional view taken of the line 2—2 of FIG. 1 showing the position of the parts of the mask in the open or non-optical filtering condition thereof.
Figure 3:
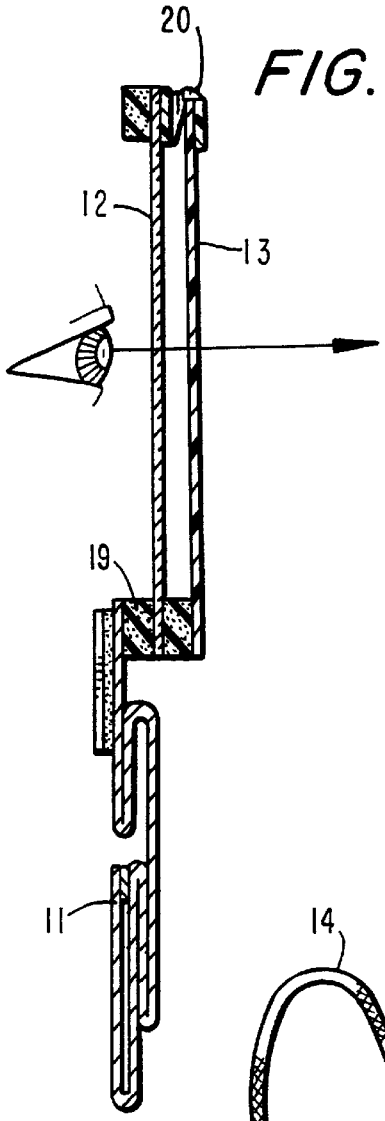
FIG. 3 is a view similar to FIG. 2 showing the component parts in the overlapping or filtered condition of the components.
Figure 4:
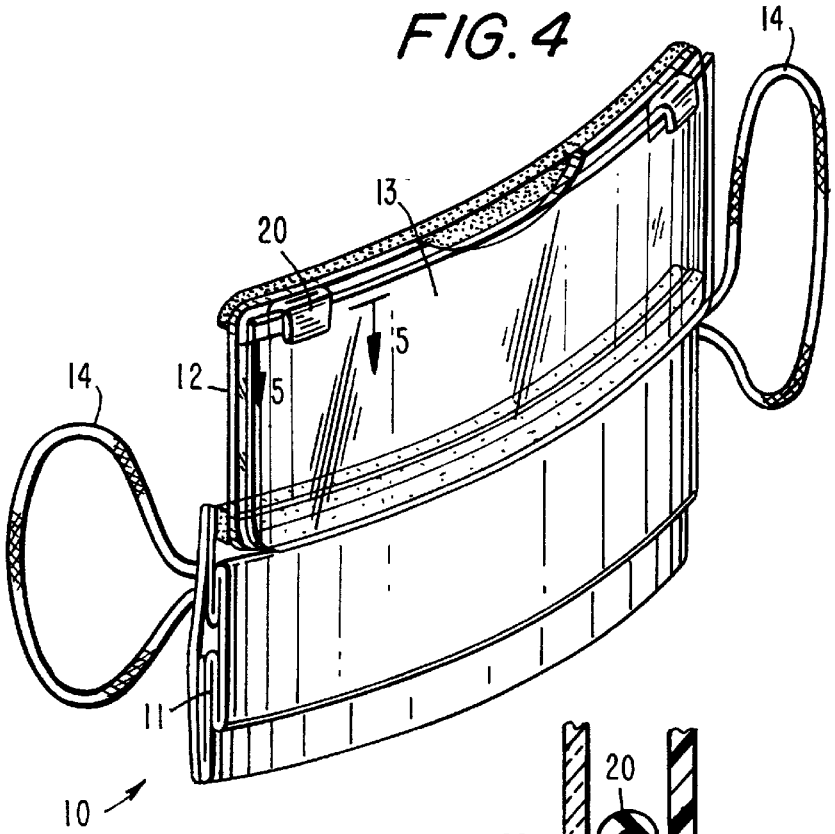
FIG. 4 is a perspective view of the mask in an arcuate configuration similar to the position it would occupy when worn.

Referring now to FIGS. 2 and 3, the optical filter component 13 is shown in FIG. 2 in its upward or inoperative position and in FIG. 3 in its downwardly folded or operative position. As will be further apparent from FIG. 4, the device in use is curved to an arcuate configuration to accommodate and encompass the face of the user.

In order to permit shifting of the optical filter component 13 between the conditions of FIGS. 2 and 3 without removing the mask from the wearer, the hinge design 20 enables a degree of relative movement between the lens component 12 and the optical filter component 13. It should be recognized that the movement of optical filter component 13 between filtering and non-filtering conditions requires the optical filter component 13, which is bowed in a first curved configuration, to be bowed in an opposite curved configuration. The combined hinges and bodily moveability provided by the hinge structure enables the user to flip the filter between the inoperative condition displayed in FIG. 2 to the operative condition of FIG. 3 without demounting the device from the face of the wearer and without buckling of the lenses. If, contrarywise, the bodily movement other than a mere hinging movement of the parts were not present, it would be necessary for the user to demount the mask, return the mask to its flatwise condition and then move the hinged components to the desired filtering or unfiltering condition and reapply the mask.

The desired shiftability as shown in FIG. 5 is provided by hinges 20 in the form of tubular members of readily flexible and deformable material, such as thin plastic or elastomer, the opposed surfaces 22, 23 of which are bonded, respectively, to the clear lens 12 and optical filter component 13. The longitudinal axes of the tubes 20 are arranged in a vertical direction. While the tubular hinge arrangement disclosed is preferred, it is readily recognized that alternate hinging mechanisms, such as a flexible foam or sheet adhesively secured to both the clear lens and filter lens, will function satisfactorily, so long as the hinge provides, in addition to a merely hinging function, a degree of bodily relative movement of the parts to permit the filter to be flipped between an inward to an outward arc without rupturing the hinge or buckling the filter.

As evidenced from the preceding disclosure, there is provided, in accordance with the invention, an inexpensive disposable surgical mask which will protect the user from air born contaminants. The device may optionally be used merely as a transparent lens for safety and optimal vision and selectively as an optical filter, as called for, without demounting the device from the wearer. The device may be shipped flat-wise and, when arcuately bent for use, provides a rigid structure. The arcuate bending of the device, particularly in the filter applied condition, functions to urge the filter component and clear lens toward each other, thus locking the two lenses in a rigid three-dimensional configuration. The bodily shiftability of the clear lens and filter lens structures, relative to each other, enables the device to be shifted between filtering and non-filtering condition without removing the component from the wearer.

As will be apparent to those skilled in the art, familiarize with the instant disclosure numerous details of construction may be varied without departing from the spirit of the invention. Accordingly, the invention is to be broadly construed within the scope of the appended claims.

What is claimed:

1. A retractable eye shield surgical mask adapted to be shipped in a planar condition and worn in an arcuate configuration, comprising a generally planar flexible respiratory filter mask member, mounting means on said respiratory filter mask member for attaching said respiratory filter mask member in covering relation of the mouth and nose areas of a wearer, said respiratory filter mask member having an upper edge portion, a transparent planar flexible lens panel secured to said respiratory filter mask member adjacent said upper edge portion, said panel having an upper panel edge portion, a generally planar flexible optical filter element, at least one yieldable tubular member interposed between said optical filter element and said lens panel adjacent said upper panel edge portion, said yieldable tubular member having opposed faces, one bonded to said optical filter element and the other bonded to said lens panel, said yieldable tubular member permitting movement of said optical filter element between two positions, namely, a first position wherein said optical filter element is disposed parallel to and overlapping said lens panel, and a second position wherein said optical filter element is offset substantially 180° from said first position.

2. A mask in accordance with claim 1, wherein said optical filter element is biased towards said lens panel when said mask is bowed to an arcuate configuration when said lens panel and optical filter element are disposed in said first position.

3. A surgical mask in accordance with claim 1 wherein said at least one yieldable tubular member connects said lens panel and said optical filter element such that said lens panel and optical filter element are both hingedly connected and moveable toward and away from each other.

4. A surgical mask in accordance with claim 1, further comprising two said tubular hinge members, wherein the longitudinal axes of said tubular hinge members are parallel.

* * * * *